US007609238B2

(12) United States Patent
Chang

(10) Patent No.: US 7,609,238 B2
(45) Date of Patent: Oct. 27, 2009

(54) DUAL-SCAN CIRCUIT FOR DRIVING AN OLED DISPLAY DEVICE

(75) Inventor: Chin-Tien Chang, Tainan (TW)

(73) Assignee: Himax Technologies, Inc. (TW)

( * ) Notice: Subject to any disclaimer, the term of this patent is extended or adjusted under 35 U.S.C. 154(b) by 574 days.

(21) Appl. No.: 11/425,628

(22) Filed: Jun. 21, 2006

(65) Prior Publication Data

US 2007/0296650 A1 Dec. 27, 2007

(51) Int. Cl.

| | |
|---|---|
| ***G09G 3/32*** | (2006.01) |
| ***G09G 3/30*** | (2006.01) |
| ***G09G 3/28*** | (2006.01) |
| ***G09G 3/36*** | (2006.01) |

(52) U.S. Cl. ..... 345/82; 345/76; 345/60; 345/92

(58) Field of Classification Search ..... 345/76, 345/82, 103

See application file for complete search history.

(56) References Cited

U.S. PATENT DOCUMENTS

| | | | | |
|---|---|---|---|---|
| 6,271,809 | B1 * | 8/2001 | Kim | 345/60 |
| 6,924,786 | B2 * | 8/2005 | Hebiguchi | 345/103 |
| 2004/0051690 | A1 * | 3/2004 | Chang | 345/92 |
| 2005/0259095 | A1 * | 11/2005 | Kwak | 345/204 |
| 2006/0038757 | A1 * | 2/2006 | Lee et al. | 345/77 |
| 2006/0055645 | A1 * | 3/2006 | Kim | 345/87 |

* cited by examiner

*Primary Examiner*—Sumati Lefkowitz
*Assistant Examiner*—Charles Hicks
(74) *Attorney, Agent, or Firm*—Baker & McKenzie LLP

(57) ABSTRACT

A luminescent display device is disclosed. The luminescent display device is comprised of an array of pixels, a first driving chip and a second driving chip. The array of pixels is comprised of columns and rows of pixels. The first driving chip is connected a first pixel of the array of pixels, and the second driving chip is connected to a second pixel of the array of pixels. The second pixel is adjacent to the first pixel. The first driving chip is not connected to all pixels in a row of the at least one row of pixels.

17 Claims, 6 Drawing Sheets

DUAL-SCAN CIRCUIT FOR DRIVING AN OLED DISPLAY DEVICE

BACKGROUND OF THE INVENTION

1. Field of the Invention

The present invention generally relates to a circuit for driving an organic light emitting diode (hereinafter referred to as "OLED") display, and in particular certain embodiments of the present invention relate to a dual-scan circuit for driving an OLED display device.

2. Description of the Related Art

An OLED display device is an electro-luminescence device. Generally, an OLED display device is made of a stack of layers on a glass substrate. The stack of layers is generally formed by an anode electrode, a hole-injection layer, a light-emitting layer, an electron-injection layer, and a cathode electrode in sequence. The anode electrode is an electrically conductive material formed and patterned on the glass substrate.

When a current source is applied to the OLED display device, there is an electric potential difference between the anode electrode and the cathode electrode. The holes in the hole-injection layer will be pushed toward the direction of the cathode electrode, and the electrons in the electron-injection layer will be pushed toward the direction of the anode electrode. The holes and the electrons combine in the light-emitting layer, and light with a specific wavelength is emitted from the light-emitting layer. It is worth noting that the light intensity emitted by the OLED display device is proportional to the driving current of the current source.

An OLED display device includes an array of pixels. For example, an OLED display device with an array of n*m pixels contains n rows and m columns of pixels. Each pixel is connected to a specific row line and a specific column line. Hence, the OLED display device with an array of n*m pixels contains "n" numbers of row lines and "m" numbers of column lines. The row lines and the column lines are connected to the current source(s), e.g., one or more driving chips. The intersection of each row line and each column line locates a pixel, which contains an OLED.

The "dual-scan" method is a technique for shortening an addressing period. According to the technique, the array of pixels is divided into two groups, using two independent driving chips to drive the two groups separately. Referring now to FIG. 1, a schematic circuit diagram of a traditional OLED display device using the dual-scan method is shown. The traditional OLED display device contains an array of n*m pixels, each of which is connected to a specific row line and a specific column line. Each pixel contains an OLED 10.

Referring to FIG. 1, the first column of pixels is connected to the first column line, shown as "CL1", and the second column of pixels is connected to the second column line, shown as "CL2". The final, m-th column of pixels is connected to the m-th column line, shown as "CLm". Each of the column lines in the upper half of the array is connected to the first driving chip 20, and each of the column lines in the lower half of the array is connected to the second driving chip 30.

Referring again to FIG. 1, the first row of pixels is connected to the first row line, shown as "RL1", and the second row of pixels is connected to the second row line, shown as "RL2". The $(n_{/2})$-th column of pixels is connected to the $(n_{/2})$-th row line, shown as "$RLn_{/2}$". All of the $RL_1$ to $RL_{n/2}$ row lines are connected to the first driving chip 20. In other word, the upper half of the pixels of the OLED display device is driven by the first driving chip 20.

Still referring to FIG. 1, the $(n_{/2}+1)$-th row of pixels is connected to the $(n_{/2}+1)$-th row line, shown as "$RL(n_{/2}+1)$", and the n-th row of pixels is connected to the n-th row line, shown as "RLn". All of the $RL(n_{/2}+1)$ to $RL_n$ row lines are connected to the second driving chip 30. In other word, the lower hall of the pixels of the OLED display device is driven by the second driving chip 30.

In accordance with the dual-scan method two rows can be selected simultaneously. One advantage of this is that the addressing period is half of that in the single scan method in which only one row is selected at one time. However, there are generally unavoidable electric characteristic differences between the two driving chips 20, 30 because of unavoidable manufacture deviations, different operation temperature, and/or different power levels of the current sources. The electric characteristic differences may result in different driving currents being provided by the different driving chips. As mentioned above, such different driving currents would cause different light intensities to be emitted from the OLED pixels. This, in turn, would result in different brightnesses between the upper part of the OLED display device and the lower part of the OLED display device.

In other words, by using the traditional dual-scan method, the upper part of the OLED display device is frequently brighter than the lower part of the OLED display device, or vice versa. This brightness difference reduces the value of the OLED products and also is disliked by users.

FIG. 2 shows a schematic diagram of the brightness difference of an OLED display device driven by the traditional dual-scan method. The "white circles" in FIG. 2 represent "brighter pixels", and the "black circles" in FIG. 2 represent "darker pixels". FIG. 2 shows that the upper half of the OLED display device is brighter than the lower half of the OLED display device. The reason is that the driving current of the first driving chip, which drives the upper half, is larger than that of the second driving chip, which drives the lower half of the OLED display device. This is due to the unavoidable electric characteristic differences between the two driving chips mentioned above. Such a brightness difference would be disliked by users.

Therefore, there is a need to create a new dual-scan circuit and method to overcome the above-mentioned problem.

SUMMARY OF THE INVENTION

Certain embodiments of the present invention are directed to a pixel scheme in a dual scan OLED displaying device capable of providing improved picture quality.

Certain embodiments of the present invention are also directed to an IC driving method for a dual scan OLED displaying device capable of providing improved picture quality.

Certain embodiments of the present invention relate to a luminescent display device comprised of an array of pixels, a first driving chip and a second driving chip. The array of pixels is comprised of columns and rows of pixels. The first driving chip is connected to a first pixel of the array of pixels, and the second driving chip is connected to a second pixel of the array of pixels. The second pixel is adjacent to the first pixel. The first pixel and the second pixel may be located in the sane column, or the same row. The first driving chip is not connected to all pixels in a row of the array of pixels.

Certain embodiments of the present invention concern a luminescent display device comprised of an array of pixels, a first driving chip and a second driving chip. The array of pixels is comprised of columns and rows of pixels. The first driving chip is connected to first and second pixels of the array of pixels. The second driving chip is connected to third and fourth pixels of the array of pixels. The first pixel is adjacent to the second pixel, and the third pixel is adjacent to the fourth pixel. The second pixel is also adjacent to the third pixel, and the second pixel is between the first pixel and the third pixel. The first driving chip is not connected to all pixels in a row of the array of pixels. The first, second, third and fourth pixels can be located in the same column or the same row.

Certain embodiments of the present invention concern a luminescent display device comprised of an array of pixels, a first driving chip and a second driving chip. The array of pixels is comprised of columns and rows of pixels. The first driving chip is connected to first, second, third and fourth pixels of the array of pixels. The second driving chip is connected to fifth, sixth, seventh and eighth pixels of the array of pixels. The first pixel is adjacent to the second pixel, and the fifth pixel is adjacent to the sixth pixel. The second pixel is adjacent to the fifth pixel, and the second pixel is between the first pixel and the fifth pixel. The third pixel is adjacent to the fourth pixel, and the seventh pixel is adjacent to the eighth pixel. The fourth pixel is adjacent to the seventh pixel, and the fourth pixel is between the third pixel and the seventh pixel. The first, second, fifth and sixth pixels can be located in the same column or the same row. The third, fourth, seventh and eighth pixels can be located in the same column or the same row. The first driving chip is not connected to all pixels in a row of the array of pixels.

DETAILED DESCRIPTION OF PREFERRED EMBODIMENTS

Certain embodiments of the present invention relate to a luminescent display device. The luminescent display device includes an array of pixels, which are driven by two driving chips. The luminescent display device can be a passive OLED panel, an active OLED panel, a light emitting diode (hereinafter referred to as "LED") panel, or any other kind of luminescent display device, especially luminescent display devices without backlighting. It should be noted that if the OLED display device is an active OLED panel, a pixel in the OLED display device may contain at least a switch and an OLED.

Figure 1:
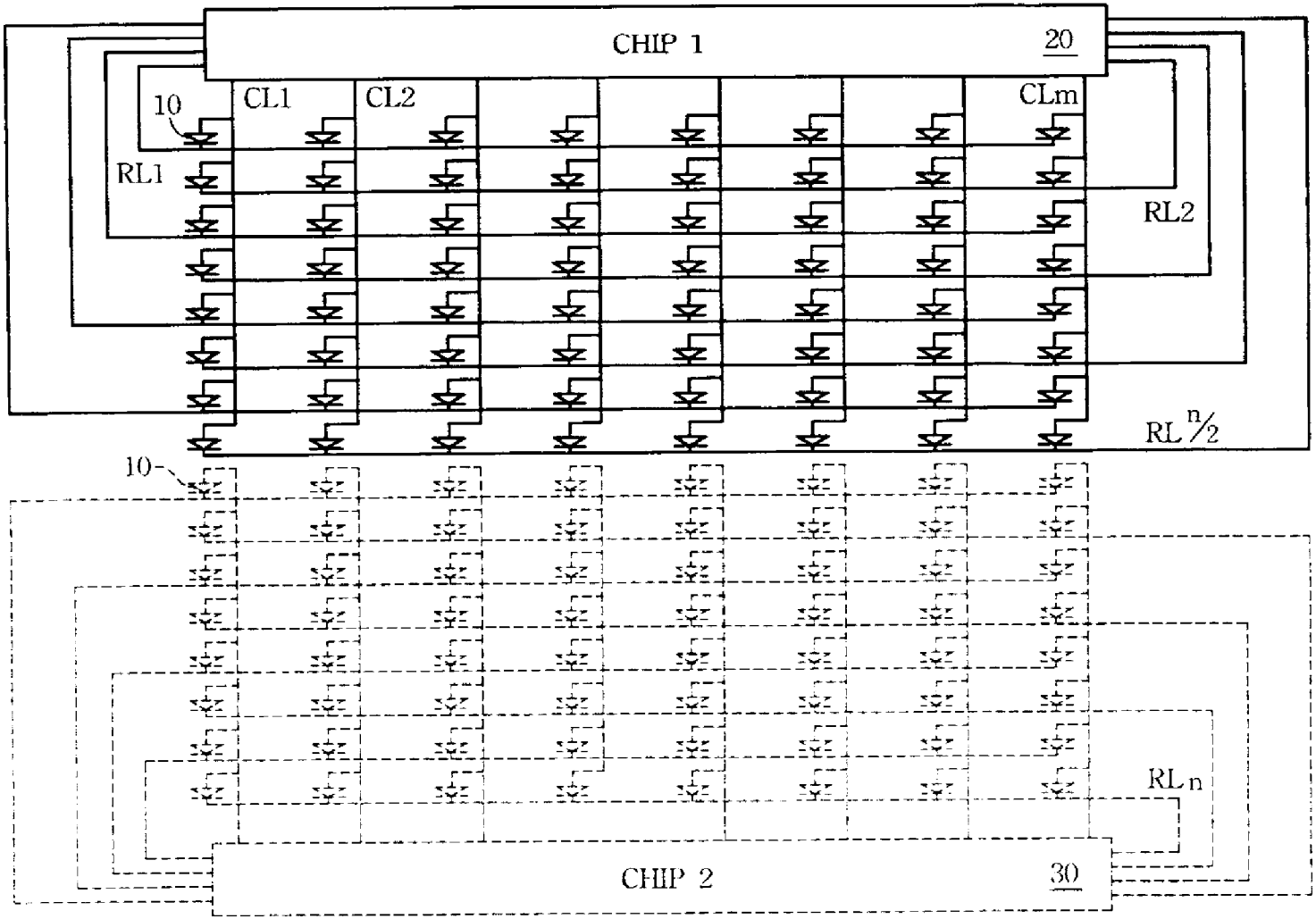
Fig. 1 (Prior Art)
FIG. 1 is a schematic circuit diagram of a traditional OLED display device using a prior art dual-scan method.
Figure 2:
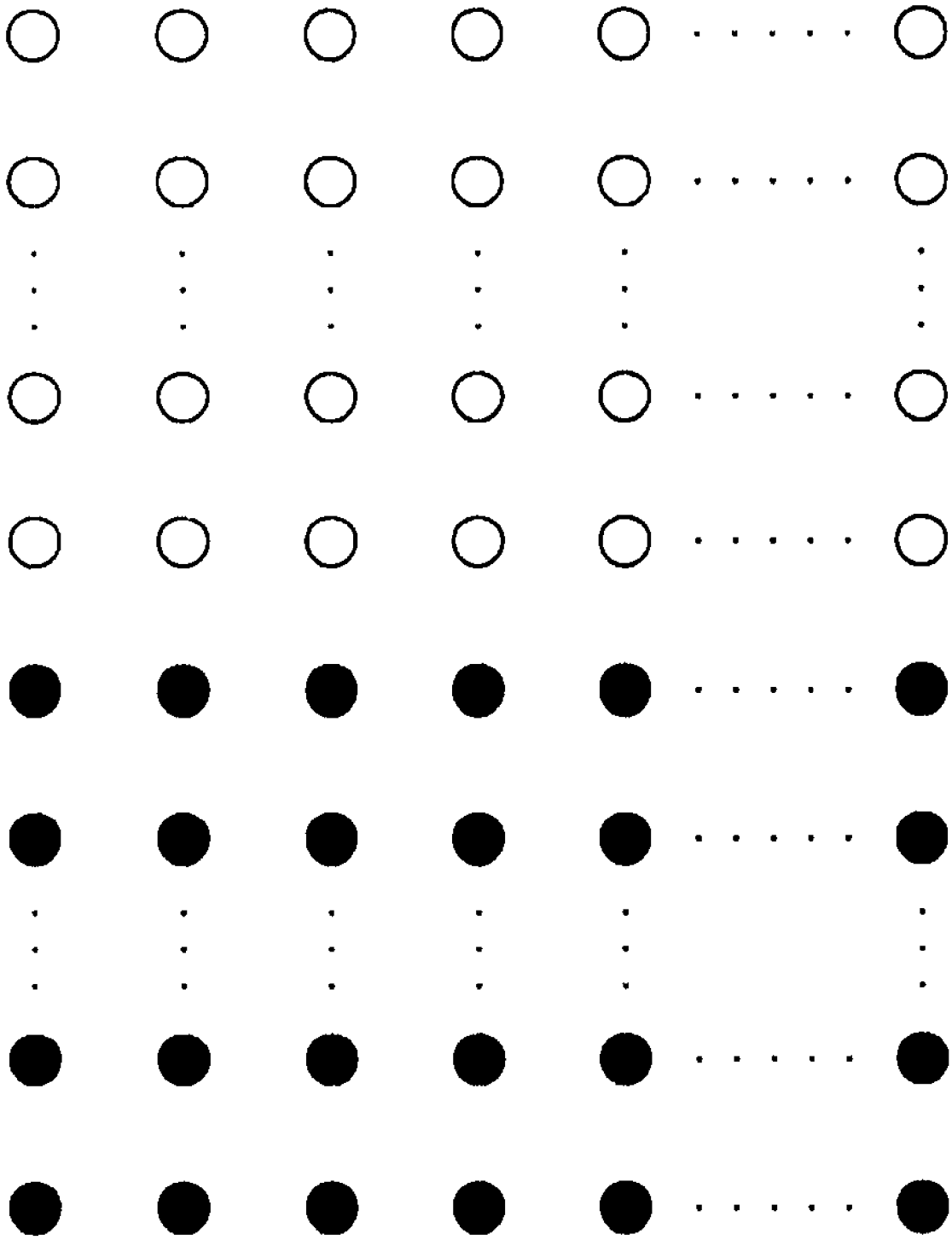
Fig. 2 (Prior Art)
FIG. 2 is a schematic diagram of the brightness difference of an OLED display device driven by a traditional dual-scan method.
Figure 3:
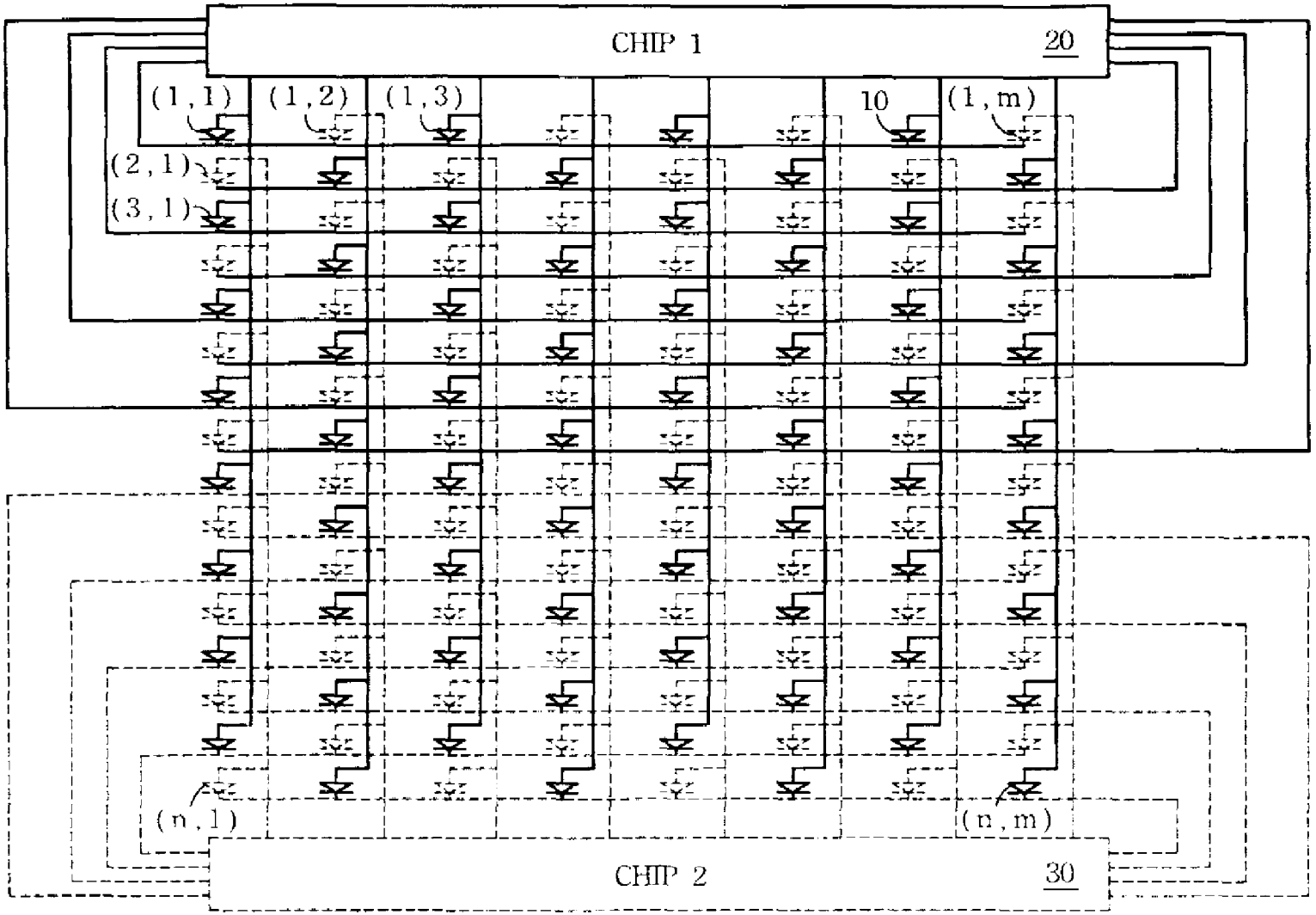
FIG. 3 illustrates a schematic circuit diagram according to a first embodiment of the present invention.

FIG. 3 illustrates a schematic circuit diagram according to a first embodiment of the present invention. In this embodiment, pixels in the array are alternatively connected and driven by the first driving chip 20 and the second driving chip 30. Each of the pixels contains an OLED 10.

In FIG. 3 the pixel at the intersection of the first row line and the first column line (the upper left most one in FIG. 3) is designated by "pixel (1,1)", and the pixel at the intersection of the second row line and the first column line is designated by "pixel (2,1)". Similarly, the pixel at the intersection of the first row line and the second column line is designated by "pixel (1,2)", and the pixel at the intersection of the second row line and the second column line is designated by "pixel (2,2)". The pixel at the intersection of the n-th row line and the first column line is designated by "pixel (n,1)", and the pixel at the intersection of the first row line and the m-th column line and is designated by "pixel (1,m)". Finally, the pixel at the intersection of the n-th row line and the m-th column line (the right most one in FIG. 3) is designated by "pixel (n,m)".

According to the first embodiment of the present invention, the pixel (1,1) is driven by the first driving chip 20. On the other hand, the pixel just beneath it, i.e. the pixel (2,1), is driven by the second driving chip 30. Alternately, the pixel just beneath the pixel (2,1), i.e. the pixel (3,1), is again driven by the first driving chip 20. Assuming that "n" is an even number in this embodiment, then pixel (n,1), the lower left most one in FIG. 3, is driven by the second driving chip 30.

According to another embodiment of the present invention, the number "n" is an odd number in which case pixel (n,1) is driven by the first driving chip 20.

The pixel just adjacent to the pixel (1,1), i.e. the pixel (1,2), is driven by the second driving chip 30. In alternating fashion, the pixel just beneath the pixel (1,2), i.e. the pixel (2,2), is driven by the first driving chip 20; furthermore, the pixel just adjacent to the pixel (1,2), i.e. the pixel (1,3), is also driven by the first driving chip 20. Finally, assuming that the number "m" is an even number in this embodiment, the pixel (1,m), i.e., the upper right most one in the FIG. 3, is driven by the second driving chip 30.

According to another embodiment of the present invention, the number "m" is an odd number in which case pixel (1,m) is driven by the first driving chip 20.

Figure 4:
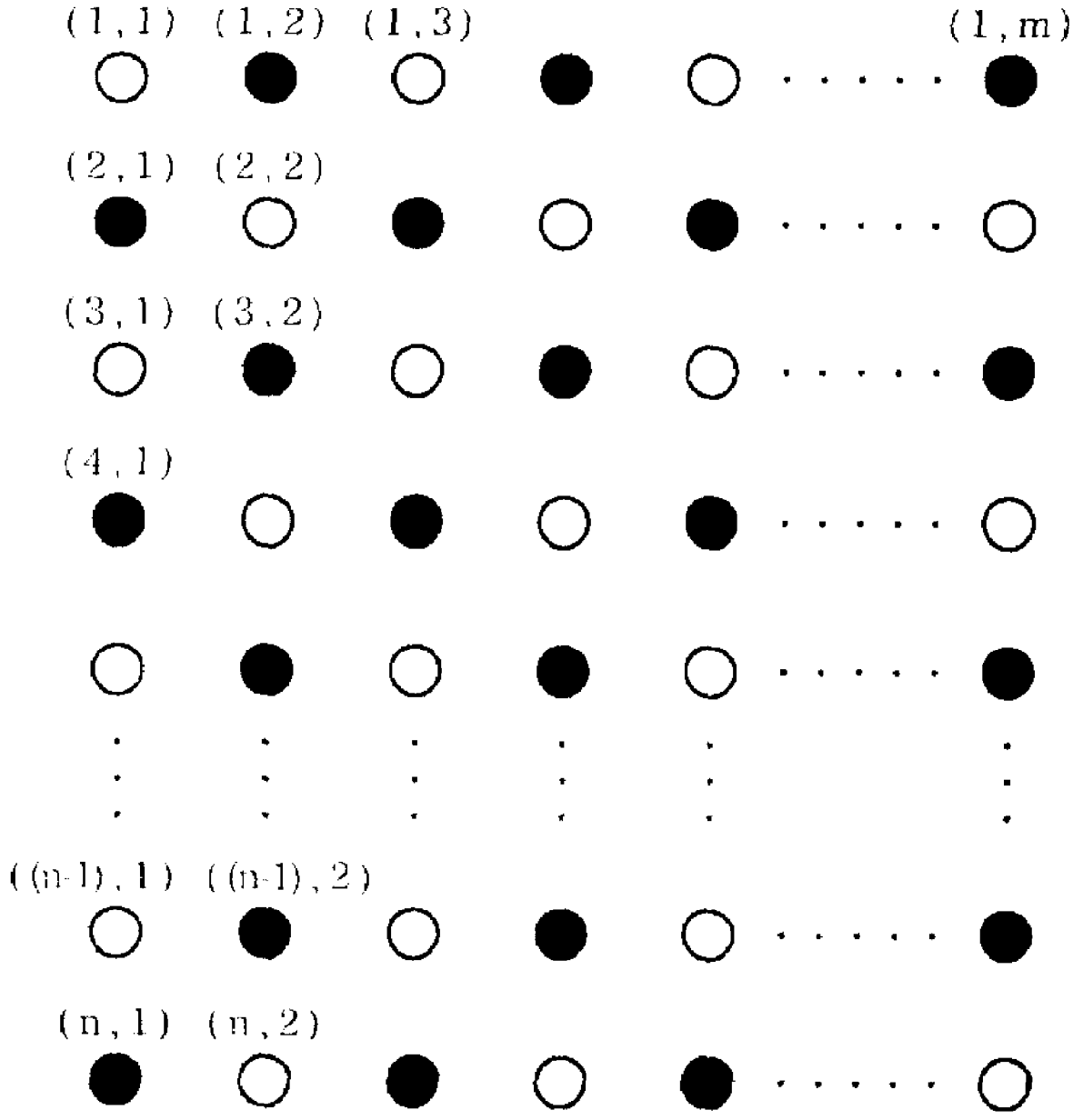
FIG. 4 is a schematic diagram showing the brightness of each pixel of an OLED display device driven by a circuit according to the first embodiment of the present invention.

FIG. 4 is a schematic diagram showing the brightness of each pixel of an OLED display device driven by a circuit according to the first embodiment of the present invention. The "white circles" in the FIG. 4 represent brighter pixels, and the "black circles" represent darker pixels. In other word, the OLED display device shows an alternating pattern of brighter and darker pixels.

Assuming that the driving current from the first driving chip 20 is larger than that from the second driving chip 30, then the pixels driven by the first driving chip 20 will be brighter than those driven by the second driving chip 30. Therefore in the example, the pixel (1,1), the pixel (3,1) . . . and the pixel ((n−1),1), which are driven by the first driving chip 20, are brighter pixels. For the same reason, the pixel (2,2), the pixel (4,2) . . . and the pixel (n,2) driven by the first driving chip 20 are also brighter pixels. On the other hand, the pixel (2,1), the pixel (4,1) . . . and the pixel (n,1), which are driven by the second driving chip 30, are darker pixels. For the same reason, the pixel (1,2), the pixel (3,2) . . . and the pixel ((n−1),2), driven by the second driving chip 30, are also darker pixels.

Another embodiment of the present invention discloses the opposite arrangement. That is, the pixel (1,1), the pixel (3,1) . . . and the pixel ((n−1),1) are driven by the second driving chip 30, and the pixel (2,1), the pixel (4,1) . . . and the pixel (n,1) are driven by the first driving chip 20.

These alternate arrangements allow the brightness variations to be averaged out. In other words, deviations will be offset by this arrangement because human eyes may not be able to discern the differences. For this reason, the problem of the brightness difference between the upper half and the lower half of the OLED display device in the prior art is thus solved in certain embodiments of the invention.

Figure 5:
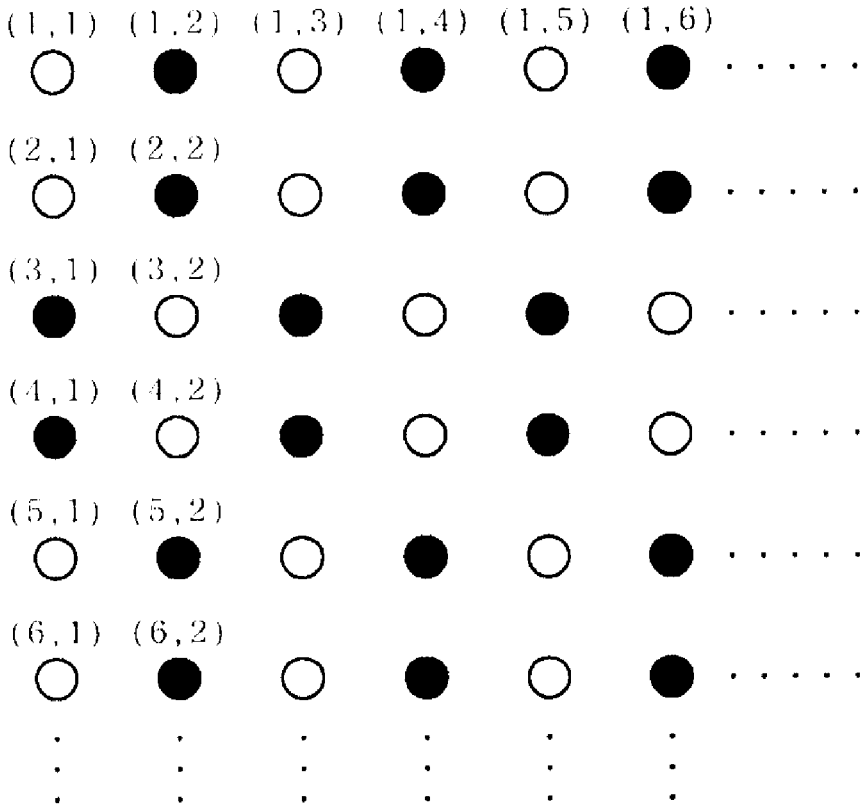
FIG. 5 is a schematic diagram showing the brightness of each pixel of an OLED display device driven by a circuit according to another embodiment of the present invention.

FIG. 5 is a schematic diagram showing the brightness of each pixel of an OLED display device driven by a circuit according to another embodiment of the present invention. The "white circles" in the FIG. 5 represent brighter pixels, and the "black circles" represent darker pixels.

Again, assuming that the driving current from the first driving chip 20 is larger than that from the second driving chip 30, then the pixels driven by the first driving chip 20 will be brighter than those driven by the second driving chip 30. Therefore, the pixel (1,1), the pixel (2,1), the pixel (5,1), and the pixel (6,1) and so on are driven by the first driving chip 20, and thus are brighter pixels. The pixel (3,2), the pixel (4,2), the pixel (7,2), and the pixel (8,2) and so on are also driven by the first driving chip 20, and thus are also brighter pixels. On the other hand, the pixel (3,1), the pixel (4,1), the pixel (7,1), and the pixel (8,1) and so on are driven by the second driving chip 30, and thus are darker pixels. The pixel (1,2), the pixel (2,2), the pixel (5.2), and the pixel (6,2) and so on are also driven by the second driving chip 30, and thus are also darker pixels.

Another embodiment of the present invention discloses the opposite arrangement. That is, the pixel (1,1), the pixel (2,1), the pixel (5,1), and the pixel (6,1) and so on are driven by the second driving chip 30, and the pixel (3,1), the pixel (4,1), the pixel (7,1), and the pixel (8,1) and so on are driven by the first driving chip 20.

These alternate arrangements allow the brightness variations to be averaged out. In other words, deviations will be offset by this arrangement because human eyes may not be able to discern the differences. For this reason, the problem of the brightness difference between the upper half and the lower half of the OLED display device in the prior art is thus solved in certain embodiments of the invention.

Figure 6:
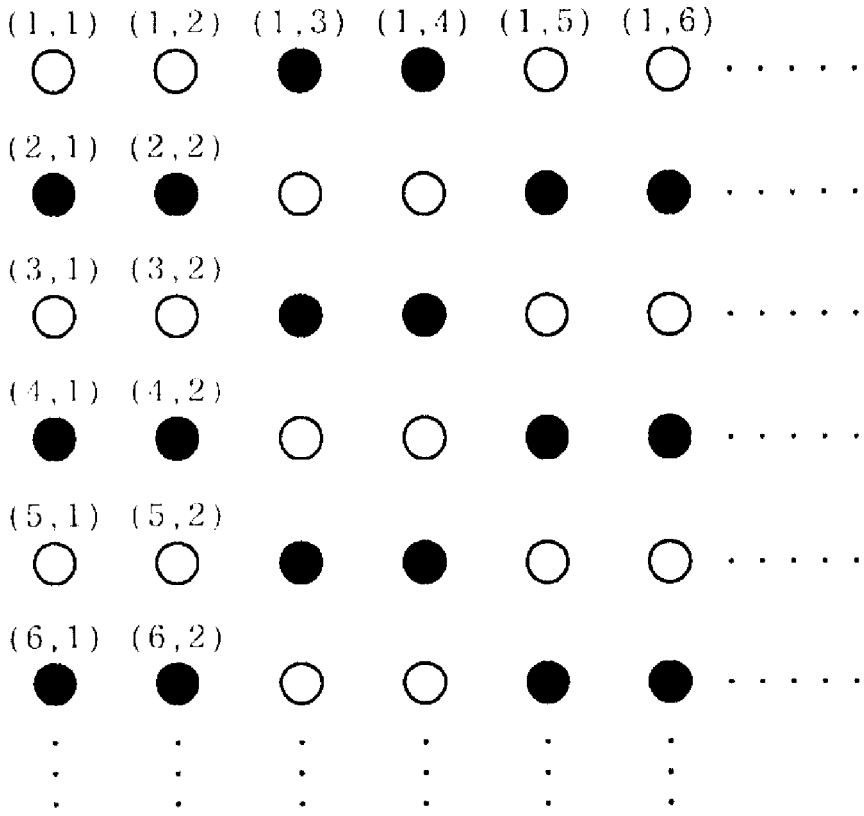
FIG. 6 is a schematic diagram showing the brightness of each pixel of an OLED display device driven by a circuit according to another embodiment of the present invention.

FIG. 6 is a schematic diagram showing the brightness of each pixel of an OLED display device driven by a circuit according to another embodiment of the present invention. The "white circles" in the FIG. 6 represent brighter pixels, and the "black circles" represent darker pixels.

Again, assuming that the driving current from the first driving chip 20 is larger than that from the second driving chip 30, then the pixels driven by the first driving chip 20 is brighter than those driven by the second driving chip 30. Therefore, the pixel (1,1), the pixel (1,2), the pixel (1,5), and the pixel (1,6) and so on are driven by the first driving chip 20, and thus are brighter pixels. The pixel (2,3), the pixel (2,4), the pixel (2,7), and the pixel (2,8) and so on are also driven by the first driving chip 20, and thus are also brighter pixels. On the other hand, the pixel (1,3), the pixel (1,4), the pixel (1,7), and the pixel (1,8) and so on are driven by the second driving chip 30, and thus are darker pixels. The pixel (2,1), the pixel (2,2), the pixel (2,5), and the pixel (2,6) and so on are also driven by the second driving chip 30, and thus are also darker pixels.

Another embodiment of the present invention discloses the opposite arrangement. That is, the pixel (1,1), the pixel (1,2), the pixel (1,5), and the pixel (1,6) and so on are driven by the second driving chip 30, and the pixel (1,3), the pixel (1,4), the pixel (1,7), and the pixel (1,8) and so on are driven by the first driving chip 20.

These alternate arrangements allow the brightness variations to be averaged out. In other words, deviations will be offset by this arrangement because human eyes would not be able to discern the differences. For this reason, the problem of the brightness difference between the upper half and the lower half of the OLED display device in the prior art is thus solved in certain embodiments of the invention.

Figure 7:
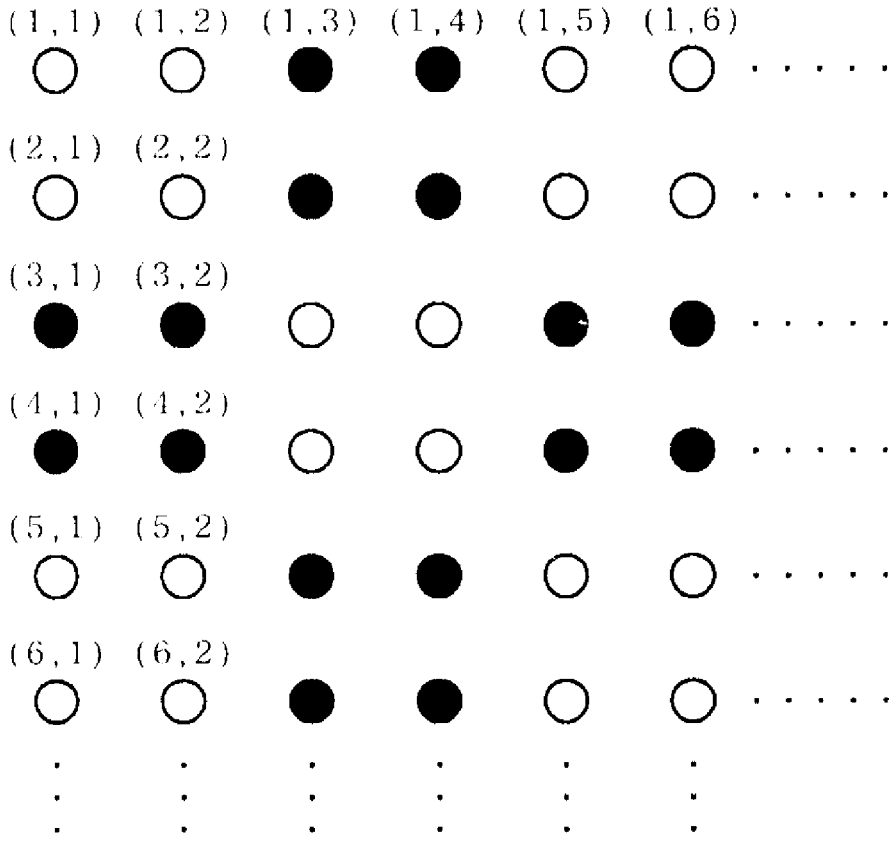
FIG. 7 is a schematic diagram showing the brightness of each pixel of an OLED display device driven by a circuit according to another embodiment of the present invention.

FIG. 7 is a schematic diagram showing the brightness of each pixel of an OLED display device driven by a circuit according to another embodiment of the present invention. The "white circles" in the FIG. 7 represent brighter pixels, and the "black circles" represent darker pixels.

Again, assuming that the driving current from the first driving chip 20 is larger than that from the second driving chip 30, then the pixels driven by the first driving chip 20 will be brighter than those driven by the second driving chip 30. Therefore, the pixel (1,1), the pixel (2,1), the pixel (1,2), and the pixel (2,2) and so on are driven by the first driving chip 20, and thus are brighter pixels. The pixel (3,3), the pixel (3,4), the pixel (4,3), and the pixel (4,4) and so on are also driven by the first driving chip 20, and thus are also brighter pixels. On the other hand, the pixel (3,1), the pixel (3,2), the pixel (4,1), and the pixel (4,2) and so on are driven by the second driving chip 30, and thus are darker pixels. The pixel (1,3), the pixel (1,4), the pixel (2,3), and the pixel (2,4) and so on are also driven by the second driving chip 30, and thus are also darker pixels.

Another embodiment of the present invention discloses the opposite arrangement. That is, the pixel (1,1), the pixel (2,1), the pixel (1,2), and the pixel (2,2) and so on are driven by the second driving chip 30, and the pixel (3,1), the pixel (3,2), the pixel (4,1), and the pixel (4,2) and so on are driven by the first driving chip 20.

These alternate arrangements allow the brightness variations to be averaged out. In other words, deviations will be offset by this arrangement because human eyes would not be able to discern the differences. For this reason, the problem of the brightness difference between the upper half and the lower half of the OLED display device in the prior art is thus solved in certain embodiments of the invention.

It will be apparent to those skilled in the art that various modifications and variations can be made in the disclosed embodiments without departing from the scope or spirit of the present invention. Other embodiments of the invention will be apparent to those skilled in the art from consideration of the specification and practice of the invention disclosed herein. It is intended that the specification and examples herein be considered as exemplary only, with a true scope of the invention being indicated by the following claims and their equivalents.

I claim:

1. A luminescent display device comprising:

an array of pixels, wherein said array of pixels is comprised of at least one column of pixels and at least one row of pixels, each pixel including a light-emitting diode;

a first driving chip, wherein said first driving chip is connected to a first pixel of said array of pixels; and a second driving chip, wherein said second driving chip is connected to a second pixel of said array of pixels, wherein said second pixel is adjacent to said first pixel, and said first pixel and said second pixel are located in a same column;

wherein said first driving chip is not connected to all pixels in said at least one row of pixels.

2. The luminescent display device of claim 1, wherein said luminescent display device is a passive OLED panel.

3. The luminescent display device of claim 1, wherein said luminescent display device is an active OLED panel.

4. A luminescent display device, comprising:

an array of pixels, wherein said array of pixels is comprised of at least two column of pixels and at least two row of pixels;

a first driving chip, wherein said first driving chip is connected to first and second pixels of said array of pixels; and a second driving chip, where said second driving chip is connected to third and fourth pixels of said array of pixels;

wherein:

said first pixel is adjacent to said second pixel;

said third pixel is adjacent to said fourth pixel;

said second pixel is adjacent to said third pixel;

said second pixel is between said first pixel and said third pixel; and said first driving chip is not connected to all pixels in at least one of said at least two rows of pixels.

5. The luminescent display device of claim 4, wherein said first, second, third and fourth pixels are located in a same column.

6. The luminescent display device of claim 4, wherein said first, second, third and fourth pixels are located in a same row.

7. The luminescent display device of claim 4, wherein said luminescent display device is a passive OLED panel.

8. The luminescent display device of claim 4, wherein said luminescent display device is an active OLED panel.

9. The luminescent display device of claim 4, wherein said luminescent display device is an LED panel.

10. A luminescent display device, comprising:

an array of pixels, wherein said array of pixels is comprised of at least two columns of pixels and at least two rows of pixels;

a first driving chip, wherein said first driving chip is connected to first, second, third and fourth pixels of said array of pixels; and a second driving chip, where said second driving chip is connected to fifth, sixth, seventh and eighth pixels of said array of pixels;

wherein:

said first pixel is adjacent to said second pixel;

said fifth pixel is adjacent to said sixth pixel;

said second pixel is adjacent to said fifth pixel;

said second pixel is between said first pixel and said fifth pixel;

said third pixel is adjacent to said fourth pixel;

said seventh pixel is adjacent to said eighth pixel;

said fourth pixel is adjacent to said seventh pixel;

said fourth pixel is between said third pixel and said seventh pixel; and said first driving chip is not connected to all pixels in at least one of said at least two rows of pixels.

11. The luminescent display device of claim 10, wherein said first, second, fifth and sixth pixels are located in a same column.

12. The luminescent display device of claim 10, wherein said first, second, fifth and sixth pixels are located in a same row.

13. The luminescent display device of claim 10, wherein said third, fourth, seventh and eighth pixels are located in a same column.

14. The luminescent display device of claim 10, wherein said third, fourth, seventh, and eighth pixels are located in a same row.

15. The luminescent display device of claim 10, wherein said luminescent display device is a passive OLED panel.

16. The luminescent display device of claim 10, wherein said luminescent display device is an active OLED panel.

17. The luminescent display device of claim 10, wherein said luminescent display device is an LED panel.

* * * * *

UNITED STATES PATENT AND TRADEMARK OFFICE

CERTIFICATE OF CORRECTION

PATENT NO. : 7,609,238 B2
APPLICATION NO. : 11/425628
DATED : October 27, 2009
INVENTOR(S) : Chin-Tien Chang It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 702 days.

Signed and Sealed this

Twelfth Day of October, 2010

David J. Kappos

David J. Kappos
*Director of the United States Patent and Trademark Office*